US010997901B2

(12) United States Patent
Nathan et al.

(10) Patent No.: US 10,997,901 B2
(45) Date of Patent: May 4, 2021

(54) DISPLAY SYSTEM

(71) Applicant: Ignis Innovation Inc., Waterloo (CA)

(72) Inventors: Arokia Nathan, Cambridge (GB); Gholamreza Chaji, Waterloo (CA); Joseph Marcel Dionne, Waterloo (CA)

(73) Assignee: Ignis Innovation Inc., Waterloo (CA)

( * ) Notice: Subject to any disclaimer, the term of this patent is extended or adjusted under 35 U.S.C. 154(b) by 132 days.

(21) Appl. No.: 14/630,906

(22) Filed: Feb. 25, 2015

(65) Prior Publication Data

US 2015/0248860 A1 Sep. 3, 2015

Related U.S. Application Data

(60) Provisional application No. 61/946,427, filed on Feb. 28, 2014.

(51) Int. Cl.
*G09G 3/32* (2016.01)
*G09G 3/3208* (2016.01)
(Continued)

(52) U.S. Cl.
CPC ..... *G09G 3/3208* (2013.01); *G09G 3/3233* (2013.01); *G09G 3/3258* (2013.01);
(Continued)

(58) Field of Classification Search
CPC .... G09G 3/032; G09G 3/3208; G09G 3/3258; G09G 3/3291; G09G 3/3233;
(Continued)

(56) References Cited

U.S. PATENT DOCUMENTS 4,354,162 A 10/1982 Wright
4,758,831 A 7/1988 Kasahara et al.
(Continued)

FOREIGN PATENT DOCUMENTS

CA 1294034 1/1992
CA 2109951 11/1992
(Continued)

OTHER PUBLICATIONS

Ahnood et al.: "Effect of threshold voltage instability on field effect mobility in thin film transistors deduced from constant current measurements"; dated Aug. 2009 (3 pages).
(Continued)

*Primary Examiner* — Benjamin C Lee
*Assistant Examiner* — Emily J Frank
(74) *Attorney, Agent, or Firm* — Stratford Managers Corporation

(57) ABSTRACT

A method of recovering a display having a plurality of pixels, each having a light emitting device and a driving transistor for driving the light emitting device. The driving transistor and the light emitting device are coupled in series between a first power supply and a second power supply. The method illuminates the semiconductor device while negatively biasing the pixel circuit with a recovery voltage different from an image programming voltage. The illuminating may follow a first cycle implementing an image display operation that includes programming the pixel circuit for a valid image and driving the pixel circuit to emit light according to the programming.

16 Claims, 8 Drawing Sheets

(51) Int. Cl.
*G09G 3/3233* (2016.01)
*G09G 3/3258* (2016.01)
*G09G 3/3291* (2016.01)

(52) U.S. Cl.
CPC ... *G09G 3/3291* (2013.01); *G09G 2300/0819* (2013.01); *G09G 2300/0852* (2013.01); *G09G 2300/0861* (2013.01); *G09G 2310/0251* (2013.01); *G09G 2310/0254* (2013.01); *G09G 2310/0256* (2013.01); *G09G 2320/045* (2013.01); *G09G 2320/048* (2013.01); *G09G 2330/027* (2013.01)

(58) Field of Classification Search
CPC ..... G09G 2310/0254; G09G 2320/045; G09G 2320/048; G09G 2330/027; G09G 2300/0852; G09G 2300/0819; G09G 2310/0256
USPC ..... 345/208, 173, 211
See application file for complete search history.

(56) References Cited

U.S. PATENT DOCUMENTS 4,963,860 A 10/1990 Stewart
4,975,691 A 12/1990 Lee
4,996,523 A 2/1991 Bell et al.
5,051,739 A 9/1991 Hayashida et al.
5,222,082 A 6/1993 Plus
5,266,515 A 11/1993 Robb et al.
5,498,880 A 3/1996 Lee et al.
5,589,847 A 12/1996 Lewis
5,619,033 A 4/1997 Weisfield
5,648,276 A 7/1997 Hara et al.
5,670,973 A 9/1997 Bassetti et al.
5,684,365 A 11/1997 Tang et al.
5,686,935 A 11/1997 Weisbrod
5,712,653 A 1/1998 Katoh et al.
5,714,968 A 2/1998 Ikeda
5,747,928 A 5/1998 Shanks et al.
5,748,160 A 5/1998 Shieh et al.
5,784,042 A 7/1998 Ono et al.
5,790,234 A 8/1998 Matsuyama
5,815,303 A 9/1998 Berlin
5,870,071 A 2/1999 Kawahata
5,874,803 A 2/1999 Garbuzov et al.
5,880,582 A 3/1999 Sawada
5,903,248 A 5/1999 Irwin
5,917,280 A 6/1999 Burrows et al.
5,923,794 A 7/1999 McGrath et al.
5,952,789 A 9/1999 Stewart et al.
5,990,629 A 11/1999 Yamada et al.
6,023,259 A 2/2000 Howard et al.
6,069,365 A 5/2000 Chow et al.
6,081,131 A 6/2000 Ishii
6,091,203 A 7/2000 Kawashima et al.
6,097,360 A 8/2000 Holloman
6,144,222 A 11/2000 Ho
6,157,583 A 12/2000 Starnes et al.
6,166,489 A 12/2000 Thompson et al.
6,177,915 B1 1/2001 Beeteson et al.
6,225,846 B1 5/2001 Wada et al.
6,229,508 B1 5/2001 Kane
6,232,939 B1 5/2001 Saito et al.
6,246,180 B1 6/2001 Nishigaki
6,252,248 B1 6/2001 Sano et al.
6,259,424 B1 7/2001 Kurogane
6,274,887 B1 8/2001 Yamazaki et al.
6,288,696 B1 9/2001 Holloman
6,300,928 B1 10/2001 Kim
6,303,963 B1 10/2001 Ohtani et al.
6,306,694 B1 10/2001 Yamazaki et al.
6,307,322 B1 10/2001 Dawson et al.
6,316,786 B1 11/2001 Mueller et al.
6,320,325 B1 11/2001 Cok et al.
6,323,631 B1 11/2001 Juang
6,323,832 B1 11/2001 Nishizawa et al.
6,345,085 B1 2/2002 Yeo et al.
6,348,835 B1 2/2002 Sato et al.
6,365,917 B1 4/2002 Yamazaki
6,373,453 B1 4/2002 Yudasaka
6,384,427 B1 5/2002 Yamazaki et al.
6,392,617 B1 5/2002 Gleason
6,399,988 B1 6/2002 Yamazaki
6,414,661 B1 7/2002 Shen et al.
6,420,758 B1 7/2002 Nakajima
6,420,834 B2 7/2002 Yamazaki et al.
6,420,988 B1 7/2002 Azami et al.
6,433,488 B1 8/2002 Bu
6,445,376 B2 9/2002 Parrish
6,468,638 B2 10/2002 Jacobsen et al.
6,489,952 B1 12/2002 Tanaka et al.
6,501,098 B2 12/2002 Yamazaki
6,501,466 B1 12/2002 Yamagashi et al.
6,512,271 B1 1/2003 Yamazaki et al.
6,518,594 B1 2/2003 Nakajima et al.
6,524,895 B2 2/2003 Yamazaki et al.
6,531,713 B1 3/2003 Yamazaki
6,559,594 B2 5/2003 Fukunaga et al.
6,573,195 B1 6/2003 Yamazaki et al.
6,573,584 B1 6/2003 Nagakari et al.
6,576,926 B1 6/2003 Yamazaki et al.
6,580,408 B1 6/2003 Bae et al.
6,580,657 B2 6/2003 Sanford et al.
6,583,775 B1 6/2003 Sekiya et al.
6,583,776 B2 6/2003 Yamazaki et al.
6,587,086 B1 7/2003 Koyama
6,593,691 B2 7/2003 Nishi et al.
6,594,606 B2 7/2003 Everitt
6,597,203 B2 7/2003 Forbes
6,611,108 B2 8/2003 Kimura
6,617,644 B1 9/2003 Yamazaki et al.
6,618,030 B2 9/2003 Kane et al.
6,641,933 B1 11/2003 Yamazaki et al.
6,661,180 B2 12/2003 Koyama
6,661,397 B2 12/2003 Mikami et al.
6,670,637 B2 12/2003 Yamazaki et al.
6,677,713 B1 1/2004 Sung
6,680,577 B1 1/2004 Inukai et al.
6,687,266 B1 2/2004 Ma et al.
6,690,344 B1 2/2004 Takeuchi et al.
6,693,388 B2 2/2004 Oomura
6,693,610 B2 2/2004 Shannon et al.
6,697,057 B2 2/2004 Koyama et al.
6,720,942 B2 4/2004 Lee et al.
6,734,636 B2 5/2004 Sanford et al.
6,738,034 B2 5/2004 Kaneko et al.
6,738,035 B1 5/2004 Fan
6,771,028 B1 8/2004 Winters
6,777,712 B2 8/2004 Sanford et al.
6,780,687 B2 8/2004 Nakajima et al.
6,806,638 B2 10/2004 Lih et al.
6,806,857 B2 10/2004 Sempel et al.
6,809,706 B2 10/2004 Shimoda
6,859,193 B1 2/2005 Yumoto
6,861,670 B1 3/2005 Ohtani et al.
6,873,117 B2 3/2005 Ishizuka
6,873,320 B2 3/2005 Nakamura
6,878,968 B1 4/2005 Ohnuma
6,909,114 B1 6/2005 Yamazaki
6,909,419 B2 6/2005 Zavracky et al.
6,919,871 B2 7/2005 Kwon
6,937,215 B2 8/2005 Lo
6,940,214 B1 9/2005 Komiya et al.
6,943,500 B2 9/2005 LeChevalier
6,954,194 B2 10/2005 Matsumoto et al.
6,956,547 B2 10/2005 Bae et al.
6,995,510 B2 2/2006 Murakami et al.
6,995,519 B2 2/2006 Arnold et al.
7,022,556 B1 4/2006 Adachi
7,023,408 B2 4/2006 Chen et al.
7,027,015 B2 4/2006 Booth, Jr. et al.
7,034,793 B2 4/2006 Sekiya et al.
7,088,051 B1 8/2006 Cok

(56) References Cited

U.S. PATENT DOCUMENTS 7,106,285 B2 9/2006 Naugler
7,116,058 B2 10/2006 Lo et al.
7,129,914 B2 10/2006 Knapp et al.
7,129,917 B2 10/2006 Yamazaki et al.
7,141,821 B1 11/2006 Yamazaki et al.
7,161,566 B2 1/2007 Cok et al.
7,193,589 B2 3/2007 Yoshida et al.
7,199,516 B2 4/2007 Seo et al.
7,220,997 B2 5/2007 Nakata
7,235,810 B1 6/2007 Yamazaki et al.
7,245,277 B2 7/2007 Ishizuka
7,248,236 B2 7/2007 Nathan et al.
7,264,979 B2 9/2007 Yamagata et al.
7,274,345 B2 9/2007 Imamura et al.
7,274,363 B2 9/2007 Ishizuka et al.
7,279,711 B1 10/2007 Yamazaki et al.
7,304,621 B2 12/2007 Oomori et al.
7,310,092 B2 12/2007 Imamura
7,315,295 B2 1/2008 Kimura
7,317,429 B2 1/2008 Shirasaki et al.
7,319,465 B2 1/2008 Mikami et al.
7,321,348 B2 1/2008 Cok et al.
7,339,636 B2 3/2008 Voloschenko et al.
7,355,574 B1 4/2008 Leon et al.
7,358,941 B2 4/2008 Ono et al.
7,402,467 B1 7/2008 Kadono et al.
7,414,600 B2 8/2008 Nathan et al.
7,432,885 B2 10/2008 Asano et al.
7,474,285 B2 1/2009 Kimura
7,485,478 B2 2/2009 Yamagata et al.
7,502,000 B2 3/2009 Yuki et al.
7,535,449 B2 5/2009 Miyazawa
7,554,512 B2 6/2009 Steer
7,569,849 B2 8/2009 Nathan et al.
7,619,594 B2 11/2009 Hu
7,619,597 B2 11/2009 Nathan et al.
7,697,052 B1 4/2010 Yamazaki et al.
7,825,419 B2 11/2010 Yamagata et al.
7,859,492 B2 12/2010 Kohno
7,868,859 B2 1/2011 Tomida et al.
7,876,294 B2 1/2011 Sasaki et al.
7,948,170 B2 5/2011 Striakhilev et al.
7,969,390 B2 6/2011 Yoshida
7,995,010 B2 8/2011 Yamazaki et al.
8,044,893 B2 10/2011 Nathan et al.
8,115,707 B2 2/2012 Nathan et al.
8,299,984 B2 * 10/2012 Nathan ..... G09G 3/3233 315/169.3
8,378,362 B2 2/2013 Heo et al.
8,493,295 B2 7/2013 Yamazaki et al.
8,497,525 B2 7/2013 Yamagata et al.
2001/0002703 A1 6/2001 Koyama
2001/0004190 A1 6/2001 Nishi et al.
2001/0013806 A1 8/2001 Notani
2001/0015653 A1 8/2001 De Jong et al.
2001/0020926 A1 9/2001 Kujik
2001/0026127 A1 10/2001 Yoneda et al.
2001/0026179 A1 10/2001 Saeki
2001/0026257 A1 10/2001 Kimura
2001/0030323 A1 10/2001 Ikeda
2001/0033199 A1 10/2001 Aoki
2001/0038098 A1 11/2001 Yamazaki et al.
2001/0043173 A1 11/2001 Troutman
2001/0045929 A1 11/2001 Prache et al.
2001/0052606 A1 12/2001 Sempel et al.
2001/0052898 A1 12/2001 Osame et al.
2002/0000576 A1 1/2002 Inukai
2002/0011796 A1 1/2002 Koyama
2002/0011799 A1 1/2002 Kimura
2002/0011981 A1 1/2002 Kujik
2002/0015031 A1 2/2002 Fujita et al.
2002/0015032 A1 2/2002 Koyama et al.
2002/0030528 A1 3/2002 Matsumoto et al.
2002/0030647 A1 3/2002 Hack et al.
2002/0036463 A1 3/2002 Yoneda et al.
2002/0047852 A1 4/2002 Inukai et al.
2002/0048829 A1 4/2002 Yamazaki et al.
2002/0050795 A1 5/2002 Imura
2002/0053401 A1 5/2002 Ishikawa et al.
2002/0070909 A1 6/2002 Asano et al.
2002/0080108 A1 6/2002 Wang
2002/0084463 A1 7/2002 Sanford et al.
2002/0101172 A1 8/2002 Bu
2002/0101433 A1 8/2002 McKnight
2002/0113248 A1 8/2002 Yamagata et al.
2002/0122308 A1 9/2002 Ikeda
2002/0130686 A1 9/2002 Forbes
2002/0154084 A1 10/2002 Tanaka et al.
2002/0158823 A1 10/2002 Zavracky et al.
2002/0163314 A1 11/2002 Yamazaki et al.
2002/0167471 A1 11/2002 Everitt
2002/0180369 A1 12/2002 Koyama
2002/0180721 A1 12/2002 Kimura et al.
2002/0186214 A1 12/2002 Siwinski
2002/0190332 A1 12/2002 Lee et al.
2002/0190924 A1 12/2002 Asano et al.
2002/0190971 A1 12/2002 Nakamura et al.
2002/0195967 A1 12/2002 Kim et al.
2002/0195968 A1 12/2002 Sanford et al.
2003/0020413 A1 1/2003 Oomura
2003/0030603 A1 2/2003 Shimoda
2003/0062524 A1 4/2003 Kimura
2003/0063081 A1 4/2003 Kimura et al.
2003/0071804 A1 4/2003 Yamazaki et al.
2003/0076048 A1 4/2003 Rutherford
2003/0090445 A1 5/2003 Chen et al.
2003/0090447 A1 5/2003 Kimura
2003/0090481 A1 5/2003 Kimura
2003/0095087 A1 5/2003 Libsch
2003/0107560 A1 6/2003 Yumoto et al.
2003/0111966 A1 6/2003 Mikami et al.
2003/0122745 A1 7/2003 Miyazawa
2003/0140958 A1 7/2003 Yang et al.
2003/0151569 A1 8/2003 Lee et al.
2003/0169219 A1 9/2003 LeChevalier
2003/0174152 A1 9/2003 Noguchi
2003/0179626 A1 9/2003 Sanford et al.
2003/0197663 A1 10/2003 Lee et al.
2003/0206060 A1 11/2003 Suzuki
2003/0230980 A1 12/2003 Forrest et al.
2004/0027063 A1 2/2004 Nishikawa
2004/0056604 A1 3/2004 Shih et al.
2004/0066357 A1 4/2004 Kawasaki
2004/0070557 A1 4/2004 Asano et al.
2004/0080262 A1 4/2004 Park et al.
2004/0080470 A1 4/2004 Yamazaki et al.
2004/0090400 A1 5/2004 Yoo
2004/0108518 A1 6/2004 Jo
2004/0113903 A1 6/2004 Mikami et al.
2004/0129933 A1 7/2004 Nathan et al.
2004/0130516 A1 7/2004 Nathan et al.
2004/0135749 A1 7/2004 Kondakov et al.
2004/0145547 A1 7/2004 Oh
2004/0150592 A1 8/2004 Mizukoshi et al.
2004/0150594 A1 8/2004 Koyama et al.
2004/0150595 A1 8/2004 Kasai
2004/0155841 A1 8/2004 Kasai
2004/0174347 A1 9/2004 Sun et al.
2004/0174349 A1 9/2004 Libsch
2004/0179005 A1 * 9/2004 Jo ..... G09G 3/325 345/211
2004/0183759 A1 9/2004 Stevenson et al.
2004/0189627 A1 9/2004 Shirasaki et al.
2004/0196275 A1 10/2004 Hattori
2004/0201554 A1 10/2004 Satoh
2004/0207615 A1 10/2004 Yumoto
2004/0233125 A1 11/2004 Tanghe et al.
2004/0239596 A1 12/2004 Ono et al.
2004/0252089 A1 12/2004 Ono et al.
2004/0257355 A1 12/2004 Naugler
2004/0263437 A1 12/2004 Hattori
2005/0007357 A1 1/2005 Yamashita et al.
2005/0030267 A1 2/2005 Tanghe et al.
2005/0035709 A1 2/2005 Furuie et al.

(56) References Cited

U.S. PATENT DOCUMENTS

2005/0057459 A1* 3/2005 Miyazawa ..... G09G 3/3233 345/76
2005/0067970 A1 3/2005 Libsch et al.
2005/0067971 A1 3/2005 Kane
2005/0068270 A1 3/2005 Awakura
2005/0088085 A1 4/2005 Nishikawa et al.
2005/0088103 A1 4/2005 Kageyama et al.
2005/0110420 A1 5/2005 Arnold et al.
2005/0117096 A1 6/2005 Voloschenko et al.
2005/0140598 A1 6/2005 Kim et al.
2005/0140610 A1 6/2005 Smith et al.
2005/0145891 A1 7/2005 Abe
2005/0156831 A1 7/2005 Yamazaki et al.
2005/0168416 A1 8/2005 Hashimoto et al.
2005/0206590 A1 9/2005 Sasaki et al.
2005/0225686 A1 10/2005 Brummack et al.
2005/0260777 A1 11/2005 Brabec et al.
2005/0269959 A1 12/2005 Uchino et al.
2005/0269960 A1 12/2005 Ono et al.
2005/0285822 A1 12/2005 Reddy et al.
2005/0285825 A1 12/2005 Eom et al.
2006/0007072 A1 1/2006 Choi et al.
2006/0012310 A1 1/2006 Chen et al.
2006/0027807 A1 2/2006 Nathan et al.
2006/0030084 A1 2/2006 Young
2006/0038758 A1 2/2006 Routley et al.
2006/0044227 A1 3/2006 Hadcock
2006/0066527 A1 3/2006 Chou
2006/0092185 A1 5/2006 Jo et al.
2006/0097965 A1* 5/2006 Deane ..... G09G 3/3233 345/76
2006/0187154 A1* 8/2006 Tsuchida ..... G09G 3/3233 345/76
2006/0232522 A1 10/2006 Roy et al.
2006/0261841 A1 11/2006 Fish
2006/0264143 A1 11/2006 Lee et al.
2006/0273997 A1* 12/2006 Nathan ..... G09G 3/3241 345/78
2006/0284801 A1 12/2006 Yoon et al.
2007/0001937 A1 1/2007 Park et al.
2007/0001939 A1 1/2007 Hashimoto et al.
2007/0008268 A1 1/2007 Park et al.
2007/0008297 A1 1/2007 Bassetti
2007/0046195 A1 3/2007 Chin et al.
2007/0069998 A1 3/2007 Naugler et al.
2007/0080905 A1 4/2007 Takahara
2007/0080906 A1 4/2007 Tanabe
2007/0080908 A1 4/2007 Nathan et al.
2007/0080918 A1 4/2007 Kawachi et al.
2007/0103419 A1 5/2007 Uchino et al.
2007/0120785 A1* 5/2007 Kimura ..... G09G 3/3233 345/82
2007/0182671 A1 8/2007 Nathan et al.
2007/0273294 A1 11/2007 Nagayama
2007/0285359 A1 12/2007 Ono
2007/0296672 A1 12/2007 Kim et al.
2008/0042948 A1* 2/2008 Yamashita ..... G09G 3/3233 345/82
2008/0055209 A1 3/2008 Cok
2008/0074413 A1* 3/2008 Ogura ..... G09G 3/3233 345/212
2008/0088549 A1 4/2008 Nathan et al.
2008/0122803 A1 5/2008 Izadi et al.
2008/0230118 A1 9/2008 Nakatani et al.
2009/0032807 A1 2/2009 Shinohara et al.
2009/0051283 A1 2/2009 Cok et al.
2009/0096722 A1* 4/2009 Moriya ..... G09G 3/344 345/76
2009/0160743 A1 6/2009 Tomida et al.
2009/0162961 A1 6/2009 Deane
2009/0167644 A1* 7/2009 White ..... G09G 3/3233 345/76
2009/0174628 A1 7/2009 Wang et al.
2009/0184898 A1* 7/2009 Yamashita ..... G09G 3/3233 345/76
2009/0213046 A1 8/2009 Nam
2009/0262101 A1* 10/2009 Nathan ..... G09G 3/3233 345/211
2009/0284451 A1* 11/2009 Yamamoto ..... G09G 3/3233 345/77
2010/0013746 A1* 1/2010 Seto ..... G09G 3/3233 345/76
2010/0052524 A1 3/2010 Kinoshita
2010/0078230 A1 4/2010 Rosenblatt et al.
2010/0079711 A1 4/2010 Tanaka
2010/0097335 A1* 4/2010 Jung ..... G06F 3/0414 345/173
2010/0133994 A1 6/2010 Song et al.
2010/0134456 A1 6/2010 Oyamada
2010/0156279 A1 6/2010 Tamura et al.
2010/0225634 A1* 9/2010 Levey ..... G09G 3/3208 345/212
2010/0237374 A1 9/2010 Chu et al.
2010/0328294 A1 12/2010 Sasaki et al.
2011/0069059 A1* 3/2011 Lee ..... G05F 1/56 345/212
2011/0090210 A1 4/2011 Sasaki et al.
2011/0133636 A1 6/2011 Matsuo et al.
2011/0134157 A1* 6/2011 Chaji ..... G09G 3/3233 345/690
2011/0180825 A1 7/2011 Lee et al.
2012/0212468 A1* 8/2012 Govil ..... B81C 99/003 345/208
2013/0009930 A1* 1/2013 Cho ..... G09G 3/2003 345/211
2013/0032831 A1 2/2013 Chaji et al.
2013/0113785 A1 5/2013 Sumi

FOREIGN PATENT DOCUMENTS

CA 2 249 592 7/1998
CA 2 368 386 9/1999
CA 2 242 720 1/2000
CA 2 354 018 6/2000
CA 2 436 451 8/2002
CA 2 438 577 8/2002
CA 2 483 645 12/2003
CA 2 463 653 1/2004
CA 2498136 3/2004
CA 2522396 11/2004
CA 2443206 3/2005
CA 2472671 12/2005
CA 2567076 1/2006
CA 2526782 4/2006
CN 1381032 11/2002
CN 1448908 10/2003
DE 20 2006 005427 6/2006
EP 0 940 796 9/1999
EP 1 028 471 A 8/2000
EP 1 103 947 5/2001
EP 1 130 565 A1 9/2001
EP 1 184 833 3/2002
EP 1 194 013 4/2002
EP 1 310 939 5/2003
EP 1 335 430 A1 8/2003
EP 1 372 136 12/2003
EP 1 381 019 1/2004
EP 1 418 566 5/2004
EP 1 429 312 A 6/2004
EP 1 439 520 7/2004
EP 1 465 143 A 10/2004
EP 1 467 408 10/2004
EP 1 517 290 3/2005
EP 1 521 203 A2 4/2005
EP 2317499 5/2011
GB 2 205 431 12/1988
JP 09 090405 4/1997
JP 10-153759 6/1998
JP 10-254410 9/1998
JP 11 231805 8/1999
JP 11-282419 10/1999

(56) References Cited

FOREIGN PATENT DOCUMENTS

| | | | | |
|---|---|---|---|---|
| JP | 2000/056847 | | 2/2000 | |
| JP | 2000-077192 | | 3/2000 | |
| JP | 2000-089198 | | 3/2000 | |
| JP | 2000-352941 | | 12/2000 | |
| JP | 2002-91376 | | 3/2002 | |
| JP | 2002-268576 | | 9/2002 | |
| JP | 2002-278513 | | 9/2002 | |
| JP | 2002-333862 | | 11/2002 | |
| JP | 2003-022035 | | 1/2003 | |
| JP | 2003-076331 | | 3/2003 | |
| JP | 2003-150082 | | 5/2003 | |
| JP | 2003-177709 | | 6/2003 | |
| JP | 2003-271095 | | 9/2003 | |
| JP | 2003-308046 | | 10/2003 | |
| JP | 2005-057217 | | 3/2005 | |
| JP | 2006065148 | | 3/2006 | |
| JP | 2009282158 | | 12/2009 | |
| TW | 485337 | | 5/2002 | |
| TW | 502233 | | 9/2002 | |
| TW | 538650 | | 6/2003 | |
| TW | 569173 | | 1/2004 | |
| WO | WO 94/25954 | | 11/1994 | |
| WO | WO 9948079 | | 9/1999 | |
| WO | WO 01/27910 | A1 | 4/2001 | |
| WO | WO 02/067327 | A | 8/2002 | |
| WO | WO 03/034389 | A | 4/2003 | |
| WO | WO 03/063124 | | 7/2003 | |
| WO | WO 03/077231 | | 9/2003 | |
| WO | WO 03/105117 | | 12/2003 | |
| WO | WO 2004/003877 | | 1/2004 | |
| WO | WO 2004/034364 | | 4/2004 | |
| WO | WO 2005/022498 | | 3/2005 | |
| WO | WO 2005/029455 | | 3/2005 | |
| WO | WO 2005/055185 | | 6/2005 | |
| WO | WO 2006/053424 | | 5/2006 | |
| WO | WO 2006/063448 | A | 6/2006 | |
| WO | WO 2006/137337 | | 12/2006 | |
| WO | WO 2007/003877 | A | 1/2007 | |
| WO | WO 2007/079572 | | 7/2007 | |
| WO | WO 2010/023270 | | 3/2010 | |
| WO | WO 2011052472 | A1 * | 5/2011 | ..... G02F 1/13624 |

OTHER PUBLICATIONS

Alexander et al.: "Pixel circuits and drive schemes for glass and elastic AMOLED displays"; dated Jul. 2005 (9 pages).
Alexander et al.: "Unique Electrical Measurement Technology for Compensation, Inspection, and Process Diagnostics of AMOLED HDTV"; dated May 2010 (4 pages).
Ashtiani et al.: "AMOLED Pixel Circuit With Electronic Compensation of Luminance Degradation"; dated Mar. 2007 (4 pages).
Chaji et al.: "A Current-Mode Comparator for Digital Calibration of Amorphous Silicon AMOLED Displays"; dated Jul. 2008 (5 pages).
Chaji et al.: "A fast settling current driver based on the CCII for AMOLED displays"; dated Dec. 2009 (6 pages).
Chaji et al.: "A Low-Cost Stable Amorphous Silicon AMOLED Display with Full V~T- and V~O~L~E~D Shift Compensation"; dated May 2007 (4 pages).
Chaji et al.: "A low-power driving scheme for a-Si:H active-matrix organic light-emitting diode displays"; dated Jun. 2005 (4 pages).
Chaji et al.: "A low-power high-performance digital circuit for deep submicron technologies"; dated Jun. 2005 (4 pages).
Chaji et al.: "A novel a-Si:H AMOLED pixel circuit based on short-term stress stability of a-Si:H TFTs"; dated Oct. 2005 (3 pages).
Chaji et al.: "A Novel Driving Scheme and Pixel Circuit for AMOLED Displays"; dated Jun. 2006 (4 pages).
Chaji et al.: "A novel driving scheme for high-resolution large-area a-Si:H AMOLED displays"; dated Aug. 2005 (4 pages).
Chaji et al.: "A Stable Voltage-Programmed Pixel Circuit for a-Si:H AMOLED Displays"; dated Dec. 2006 (12 pages).
Chaji et al.: "A Sub-μA fast-settling current-programmed pixel circuit for AMOLED displays"; dated Sep. 2007.
Chaji et al.: "An Enhanced and Simplified Optical Feedback Pixel Circuit for AMOLED Displays"; dated Oct. 2006.
Chaji et al.: "Compensation technique for DC and transient instability of thin film transistor circuits for large-area devices"; dated Aug. 2008.
Chaji et al.: "Driving scheme for stable operation of 2-TFT a-Si AMOLED pixel"; dated Apr. 2005 (2 pages).
Chaji et al.: "Dynamic-effect compensating technique for stable a-Si:H AMOLED displays"; dated Aug. 2005 (4 pages).
Chaji et al.: "Electrical Compensation of OLED Luminance Degradation"; dated Dec. 2007 (3 pages).
Chaji et al.: "eUTDSP: a design study of a new VLIW-based DSP architecture"; dated My 2003 (4 pages).
Chaji et al.: "Fast and Offset-Leakage Insensitive Current-Mode Line Driver for Active Matrix Displays and Sensors"; dated Feb. 2009 (8 pages).
Chaji et al.: "High Speed Low Power Adder Design With a New Logic Style: Pseudo Dynamic Logic (SDL)"; dated Oct. 2001 (4 pages).
Chaji et al.: "High-precision, fast current source for large-area current-programmed a-Si flat panels"; dated Sep. 2006 (4 pages).
Chaji et al.: "Low-Cost AMOLED Television with IGNIS Compensating Technology"; dated May 2008 (4 pages).
Chaji et al.: "Low-Cost Stable a-Si:H AMOLED Display for Portable Applications"; dated Jun. 2006 (4 pages).
Chaji et al.: "Low-Power Low-Cost Voltage-Programmed a-Si:H AMOLED Display"; dated Jun. 2008 (5 pages).
Chaji et al.: "Merged phototransistor pixel with enhanced near infrared response and flicker noise reduction for biomolecular imaging"; dated Nov. 2008 (3 pages).
Chaji et al.: "Parallel Addressing Scheme for Voltage-Programmed Active-Matrix OLED Displays"; dated May 2007 (6 pages).
Chaji et al.: "Pseudo dynamic logic (SDL): a high-speed and low-power dynamic logic family"; dated 2002 (4 pages).
Chaji et al.: "Stable a-Si:H circuits based on short-term stress stability of amorphous silicon thin film transistors"; dated May 2006 (4 pages).
Chaji et al.: "Stable Pixel Circuit for Small-Area High-Resolution a-Si:H AMOLED Displays"; dated Oct. 2008 (6 pages).
Chaji et al.: "Stable RGBW AMOLED display with OLED degradation compensation using electrical feedback"; dated Feb. 2010 (2 pages).
Chaji et al.: "Thin-Film Transistor Integration for Biomedical Imaging and AMOLED Displays"; dated 2008 (177 pages).
European Search Report and Written Opinion for Application No. 08 86 5338 dated Nov. 2, 2011 (7 pages).
European Search Report for European Application No. EP 04 78 6661 dated Mar. 9, 2009.
European Search Report for European Application No. EP 05 75 9141 dated Oct. 30, 2009.
European Search Report for European Application No. EP 05 82 1114 dated Mar. 27, 2009 (2 pages).
European Search Report for European Application No. EP 07 71 9579 dated May 20, 2009.
European Search Report dated Mar. 26, 2012 in corresponding European Patent Application No. 10000421.7 (6 pages).
Extended European Search Report dated Apr. 27, 2011 issued during prosecution of European patent application No. 09733076.5 (13 pages).
Goh et al., "A New a-Si:H Thin Film Transistor Pixel Circul for Active-Matrix Organic Light-Emitting Diodes", IEEE Electron Device Letters, vol. 24, No. 9, Sep. 2003, 4 pages.
International Search Report for International Application No. PCT/CA02/00180 dated Jul. 31, 2002 (3 pages).
International Search Report for International Application No. PCT/CA2004/001741 dated Feb. 21, 2005.
International Search Report for International Application No. PCT/CA2005/001844 dated Mar. 28, 2006 (2 pages).
International Search Report for International Application No. PCT/CA2005/001007 dated Oct. 18, 2005.
International Search Report for International Application No. PCT/CA2007/000652 dated Jul. 25, 2007.

(56) References Cited

OTHER PUBLICATIONS

International Search Report for International Application No. PCT/CA2008/002307, dated Apr. 28, 2009 (3 pages).
International Search Report for International Application No. PCT/IB2011/055135, Canadian Patent Office, dated Apr. 16, 2012 (5 pages).
International Search Report dated Jul. 30, 2009 for International Application No. PCT/CA2009/000501 (4 pages).
Jafarabadiashtiani et al.: "A New Driving Method for a-Si AMOLED Displays Based on Voltage Feedback"; dated 2005 (4 pages).
Lee et al.: "Ambipolar Thin-Film Transistors Fabricated by PECVD Nanocrystalline Silicon"; dated 2006 (6 pages).
Ma e y et al: "Organic Light-Emitting Diode/Thin Film Transistor Integration for foldable Displays" Conference record of the 1997 International display research conference and international workshops on LCD technology and emissive technology. Toronto, Sep. 15-19, 1997 (6 pages).
Matsueda y et al.: "35.1: 2.5-in. AMOLED with Integrated 6-bit Gamma Compensated Digital Data Driver"; dated May 2004.
Nathan et al.: "Backplane Requirements for Active Matrix Organic Light Emitting Diode Displays"; dated 2006 (16 pages).
Nathan et al.: "Call for papers second international workshop on compact thin-film transistor (TFT) modeling for circuit simulation"; dated Sep. 2009 (1 page).
Nathan et al.: "Driving schemes for a-Si and LTPS AMOLED displays"; dated Dec. 2005 (11 pages).
Nathan et al.: "Invited Paper: a-Si for AMOLED—Meeting the Performance and Cost Demands of Display Applications (Cell Phone to HDTV)", dated 2006 (4 pages).
Nathan et al.: "Thin film imaging technology on glass and plastic" ICM 2000, Proceedings of the 12$^{th}$ International Conference on Microelectronics, (IEEE Cat. No. 00EX453), Tehran Iran; dated Oct. 31-Nov. 2, 2000, pp. 11-14, ISBN: 964-360-057-2, p. 13, col. 1, line 11-48; (4 pages).
Nathan, et al., "Amorphous Silicon Thin Film Transistor Circuit Integration for Organic LED Displays on Glass and Plastic", IEEE Journal of Solid-State Circuits, vol. 39, No. 9, Sep. 2004, pp. 1477-1486.
Office Action issued in Chinese Patent Application 200910246264.4 Dated Jul. 5, 2013; 8 pages.
Patent Abstracts of Japan, vol. 2000, No. 09, Oct. 13, 2000—JP 2000 172199 A, Jun. 3, 2000, abstract.
Patent Abstracts of Japan, vol. 2002, No. 03, Apr. 3, 2002 (Apr. 4, 2004 & JP 2001 318627 A (Semiconductor EnergyLab DO LTD), Nov. 16, 2001, abstract, paragraphs '01331-01801, paragraph '01691, paragraph '01701, paragraph '01721 and figure 10.
Philipp: "Charge transfer sensing" Sensor Review, vol. 19, No. 2, Dec. 31, 1999 (Dec. 31, 1999), 10 pages.
Rafati et al.: "Comparison of a 17 b multiplier in Dual-rail domino and in Dual-rail D L (D L) logic styles"; dated 2002 (4 pages).
Safavaian et al.: "Three-TFT image sensor for real-time digital X-ray imaging"; dated Feb. 2, 2006 (2 pages).
Safavian et al.: "3-TFT active pixel sensor with correlated double sampling readout circuit for real-time medical x-ray imaging"; dated Jun. 2006 (4 pages).
Safavian et al.: "A novel current scaling active pixel sensor with correlated double sampling readout circuit for real time medical x-ray imaging"; dated May 2007 (7 pages).
Safavian et al.: "A novel hybrid active-passive pixel with correlated double sampling CMOS readout circuit for medical x-ray imaging"; dated May 2008 (4 pages).
Safavian et al.: "Self-compensated a-Si:H detector with current-mode readout circuit for digital X-ray fluoroscopy"; dated Aug. 2005 (4 pages).
Safavian et al.: "TFT active image sensor with current-mode readout circuit for digital x-ray fluoroscopy [5969D-82]"; dated Sep. 2005 (9 pages).
Sanford, James L., et al., "4.2 TFT AMOLED Pixel Circuits and Driving Methods", SID 03 Digest, ISSN/0003, 2003, pp. 10-13.
Stewart M. et al., "Polysilicon TFT technology for active matrix OLED displays" IEEE transactions on electron devices, vol. 48, No. 5; Dated May, 2001 (7 pages).
Tatsuya Sasaoka et al., 24.4L; Late-News Paper: A 13.0-inch AM-Oled Display with Top Emitting Structure and Adaptive Current Mode Programmed Pixel Circuit (TAC), SID 01 Digest, (2001), pp. 384-387.
Vygranenko et al.: "Stability of indium-oxide thin-film transistors by reactive ion beam assisted deposition"; dated 2009.
Wang et al.: "Indium oxides by reactive ion beam assisted evaporation: From material study to device application"; dated Mar. 2009 (6 pages).
Written Opinion dated Jul. 30, 2009 for International Application No. PCT/CA2009/000501 (6 pages).
Yi He et al., "Current-Source a-Si:H Thin Film Transistor Circuit for Active-Matrix Organic Light-Emitting Displays", IEEE Electron Device Letters, vol. 21, No. 12, Dec. 2000, pp. 590-592.
Zhiguo Meng et al; "24.3: Active-Matrix Organic Light-Emitting Diode Display implemented Using Metal-Induced Unilaterally Crystallized Polycrystalline Silicon Thin-Film Transistors", SID 01Digest, (2001), pp. 380-383.
International Search Report for Application No. PCT/IB2014/059409, Canadian Intellectual Property Office, dated Jun. 12, 2014 (4 pages).
Written Opinion for Application No. PCT/IB2014/059409, Canadian Intellectual Property Office, dated Jun. 12, 2014 (5 pages).
Extended European Search Report for Application No. EP 14181848.4, dated Mar. 5, 2015, (9 pages).

* cited by examiner

DISPLAY SYSTEM

CROSS REFERENCE TO RELATED APPLICATION

This application claims the benefit of U.S. Provisional Patent Application No. 61/946,427, filed Feb. 28, 2014 (Attorney Docket No. 058161-000028PL01), which is hereby incorporated by reference in its entirety.

FIELD OF INVENTION

The present invention relates to display devices, and more specifically to a pixel circuit, a light emitting device display and an operation technique for the light emitting device display.

BACKGROUND OF THE INVENTION

Electro-luminance displays have been developed for a wide variety of devices, such as, personal digital assistants (PDAs) and cell phones. In particular, active-matrix organic light emitting diode (AMOLED) displays with amorphous silicon (a-Si), poly-silicon, organic, or other driving backplane have become more attractive due to advantages, such as feasible flexible displays, its low cost fabrication, high resolution, and a wide viewing angle.

An AMOLED display includes an array of rows and columns of pixels, each having an organic light emitting diode (OLED) and backplane electronics arranged in the array of rows and columns. Since the OLED is a current driven device, there is a need to provide an accurate and constant drive current.

However, the AMOLED displays exhibit non-uniformities in luminance on a pixel-to-pixel basis, as a result of pixel degradation. Such degradation includes, for example, aging caused by operational usage over time (e.g., threshold shift, OLED aging). Depending on the usage of the display, different pixels may have different amounts of the degradation. There may be an ever-increasing error between the required brightness of some pixels as specified by luminance data and the actual brightness of the pixels. The result is that the desired image will not show properly on the display.

Therefore, there is a need to provide a method and system that is capable of recovering displays.

SUMMARY OF THE INVENTION

It is an object of the invention to provide a method and system that obviates or mitigates at least one of the disadvantages of existing systems.

According to an aspect of the present invention there is provided a method of recovering a display having a plurality of pixels, each having a light emitting device and a driving transistor for driving the light emitting device. The driving transistor and the light emitting device are coupled in series between a first power supply and a second power supply. The method illuminates the semiconductor device while negatively biasing the pixel circuit with a recovery voltage different from an image programming voltage. The illuminating may follow a first cycle implementing an image display operation that includes programming the pixel circuit for a valid image and driving the pixel circuit to emit light according to the programming.

In one implementation, the illumination is with light in the blue or ultraviolet range. In another implementation, the illumination is generated by said semiconductor device itself. The recovery voltage is based on the performance or aging history of the pixel circuit, and the illumination and the recovery voltage may be either constant or pulsed.

Illuminating the semiconductor device while negatively biasing the pixel circuit with a recovery voltage preferably produces a negative induced VT voltage shift in the semiconductor device. The negative induced VT shift may be followed by a positive induced VT shift to minimize the gap between the performances of different pixel circuits, and the negative induced VT shift and the positive induced VT shift may be repeated multiple times.

BRIEF DESCRIPTION OF THE DRAWINGS

These and other features of the invention will become more apparent from the following description in which reference is made to the appended drawings wherein.

Figure 1:
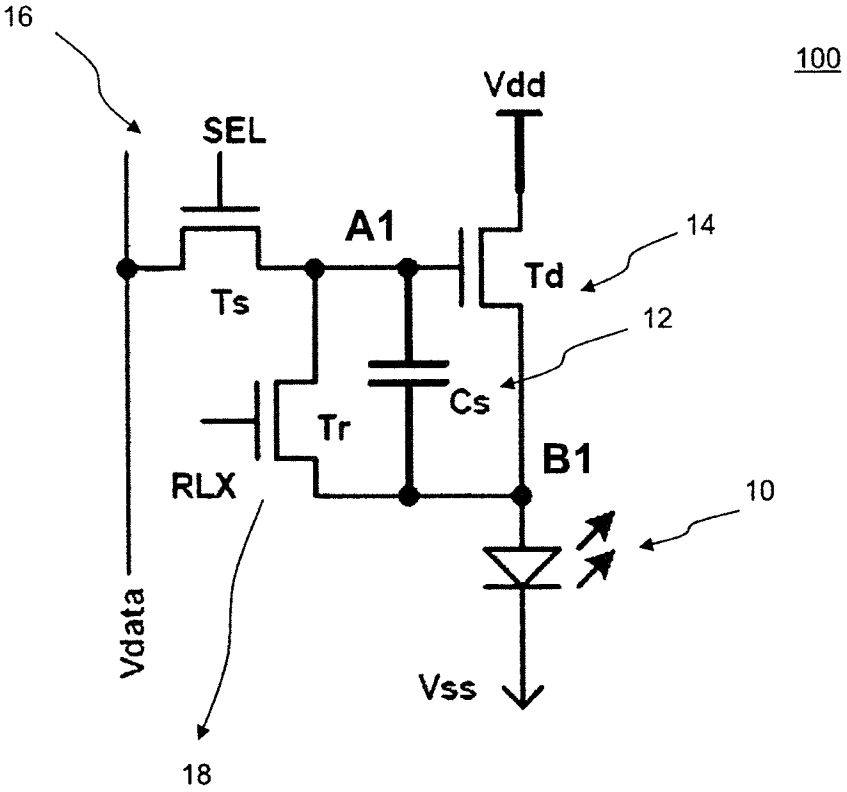
FIG. 1 is a diagram showing an example of a pixel circuit in accordance with an embodiment of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

Embodiments of the present invention are described using an active matrix light emitting display and a pixel that has an organic light emitting diode (OLED) and one or more thin film transistors (TFTs). However, the pixel may include a light emitting device other than OLED, and the pixel may include transistors other than TFTs. The transistors of the pixel and display elements may be fabricated using poly silicon, nano/micro crystalline silicon, amorphous silicon, organic semiconductors technologies (e.g., organic TFTs), NMOS technology, CMOS technology (e.g., MOSFET), metal oxide technologies, or combinations thereof.

In the description, "pixel circuit" and "pixel" are used interchangeably. In the description, "signal" and "line" may be used interchangeably. In the description, "connect (or connected)" and "couple (or coupled)" may be used interchangeably, and may be used to indicate that two or more elements are directly or indirectly in physical or electrical contact with each other.

In the embodiments, each transistor has a gate terminal, a first terminal and a second terminal where the first terminal (the second terminal) may be, but not limited to, a drain terminal or a source terminal (source terminal or drain terminal).

A relaxation driving scheme for recovering pixel components is now described in detail. FIG. 1 illustrates an example of a pixel circuit in accordance with an embodiment of the present invention. The pixel circuit 100 of FIG. 1 employs a relaxation driving scheme for recovering the aging of the pixel elements. The pixel circuit 100 includes an OLED 10, a storage capacitor 12, a driving transistor 14, a switch transistor 16, and a relaxation circuit 18. The storage capacitor 12 and the transistors 14 and 16 form a pixel driver for driving the OLED 10. In FIG. 1, the relaxation circuit 18 is implemented by a transistor 18, hereinafter referred to as transistor 18 or relaxation (switch) transistor 18. In FIG. 1, the transistors 14, 16, and 18 are n-type TFTs.

An address (select) line SEL, a data line Vdata for providing a programming data (voltage) Vdata to the pixel circuit, power supply lines Vdd and Vss, and a relaxation select line RLX for the relaxation are coupled to the pixel circuit 100. Vdd and Vss may be controllable (changeable).

The first terminal of the driving transistor 14 is coupled to the voltage supply line Vdd. The second terminal of the driving transistor 14 is coupled to the anode electrode of the OLED 10 at node B1. The first terminal of the switch transistor 16 is coupled to the data line Vdata. The second terminal of the switch transistor 16 is coupled to the gate terminal of the driving transistor at node A1. The gate terminal of the switch transistor 16 is coupled to the select line SEL. The storage capacitor is coupled to node A1 and node B1. The relaxation switch transistor 18 is coupled to node A1 and node B1. The gate terminal of the relaxation switch transistor 18 is coupled to RLX.

In a normal operation mode (active mode), the pixel circuit 100 is programmed with the programming data (programming state), and then a current is supplied to the OLED 10 (light emission/driving state). In the normal operation mode, the relaxation switch transistor 18 is off. In a relaxation mode, the relaxation switch transistor 18 is on so that the gate-source voltage of the driving transistor 16 is reduced.

Figure 2:
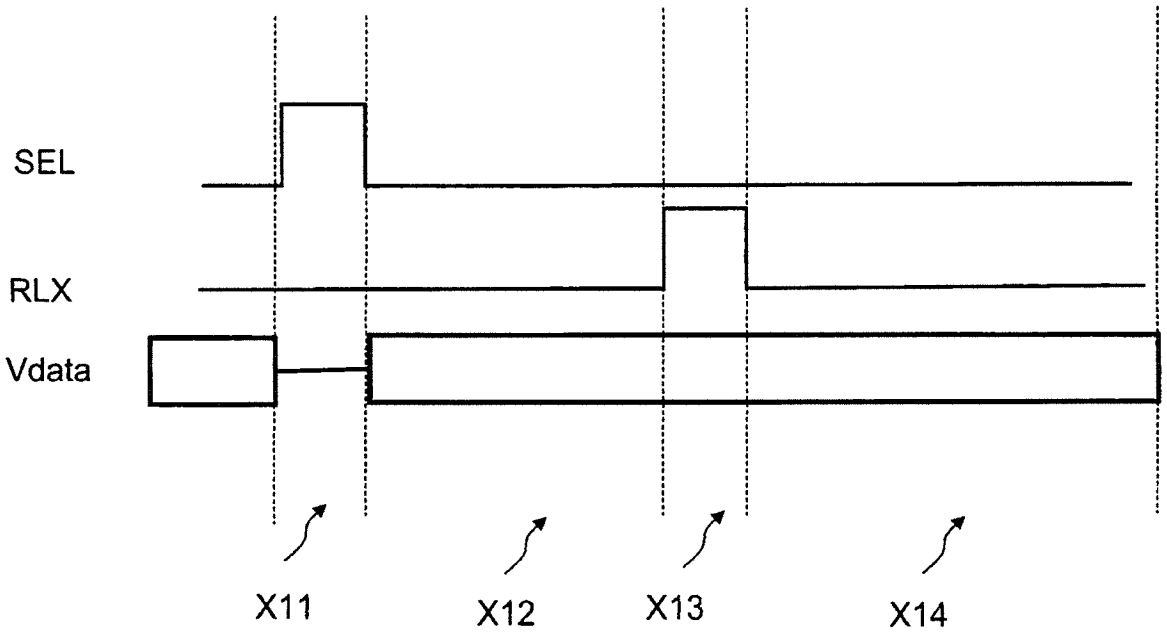
FIG. 2 is a timing diagram showing exemplary waveforms applied to the pixel circuit of FIG. 1.

FIG. 2 illustrates a driving scheme for the pixel circuit 100 of FIG. 1. The operation for the pixel circuit 100 of FIG. 1 includes four operation cycles X11, X12, X13 and X14. X11, X12, X13 and X14 may form a frame. Referring to FIGS. 1-2, during the first operation cycle X11 (programming cycle), SEL signal is high and the pixel circuit 100 is programmed for a wanted brightness with Vdata. During the second operation cycle X12 (driving cycle), the driving transistor 12 provides current to the OLED 10. During the third operation cycle X13, RLX signal is high and the gate-source voltage of the driving transistor 14 becomes zero. As a result, the driving transistor 14 is not under stress during the fourth operating cycle X14. Thus the aging of the driving transistor 14 is suppressed.

Figure 3:
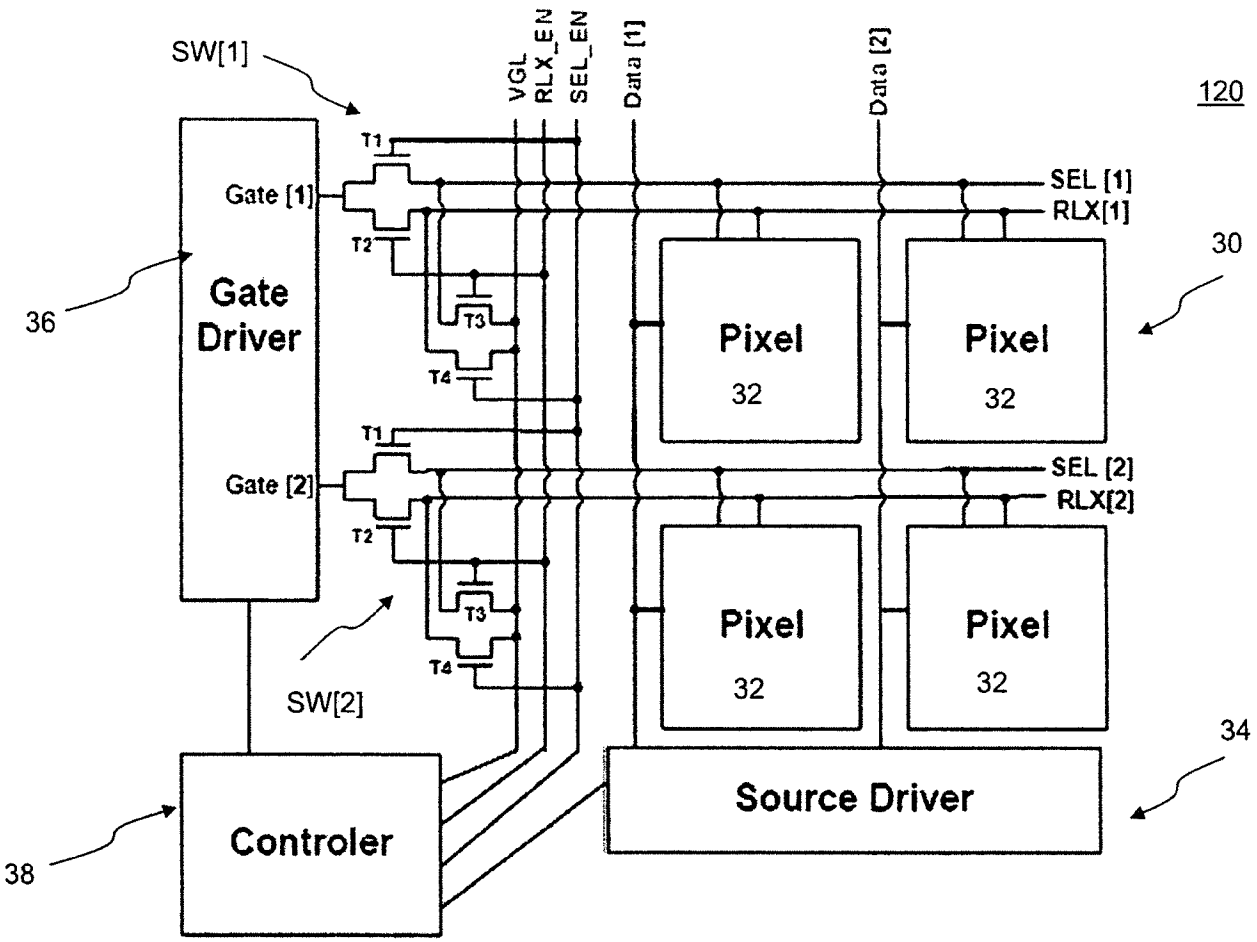
FIG. 3 is a diagram showing an example of a display system having a mechanism for a relaxation driving scheme, in accordance with an embodiment of the present invention.

FIG. 3 illustrates an example of a display system having a mechanism for a relaxation driving scheme, in accordance with an embodiment of the present invention. The display system 120 includes a display array 30. The display array 30 is an AMOLED display where a plurality of pixel circuits 32 are arranged in rows and columns. The pixel circuit 32 may be the pixel circuit 100 of FIG. 1. In FIG. 3, four pixel circuits 32 are arranged with 2 rows and 2 columns. However, the number of the pixel circuits 32 is not limited to four and may vary.

In FIG. 3, SEL[i] represents an address (select) line for the ith row (i=1, 2, . . .), which is shared among the pixels in the ith row. In FIG. 3, RLX[i] represents a relaxation (select) line for the ith row, which is shared among the pixels in the ith row. In FIG. 3, Datab[j] represents a data line for the jth column (j=1, 2, . . .), which is shared among the pixels in the jth column. SEL[i] corresponds to SEL of FIG. 1. RLX[i] corresponds to RLX of FIG. 1. Data[j] corresponds to Vdata of FIG. 1.

Data[j] is driven by a source driver 34. SEL[i] and RLX[i] are driven by a gate driver 36. The gate driver 36 provides a gate (select) signal Gate[i] for the ith row. SEL[i] and RLX[i] share the select signal Gate[i] output from the gate driver 36 via a switch circuit SW[i] for the ith row.

The switch circuit SW[i] is provided to control a voltage level of each SEL[i] and RLX[i]. The switch circuit SW[i] includes switch transistors T1, T2, T3, and T4. Enable lines SEL_EN and RLX_EN and a bias voltage line VGL are coupled to the switch circuit SW[i]. In the description, "enable signal SEL_EN" and "enable line SEL_EN" are used interchangeably. In the description, "enable signal RLX_EN" and "enable line RLX_EN" are used interchangeably. A controller 38 controls the operations of the source driver 34, the gate driver 36, SEL_EN, RLX_EN and VGL.

The switch transistor T1 is coupled to a gate driver's output (e.g., Gate[1], Gate [2]) and the select line (e.g., SEL[1], SEL[2]). The switch transistor T2 is coupled to the gate driver's output (e.g., Gate[1], Gate [2]) and the relaxation select line (e.g., RLX[1], RLX[2]). The switch transistor T3 is coupled to the select line (e.g., SEL[1], SEL[2]) and VGL. The switch transistor T4 is coupled to the relaxation select line (e.g., RLX[1], RLX[2]) and VGL. VGL line provides the off voltage of the gate driver 36. VGL is selected so that the switches are Off.

The gate terminal of the switch transistor T1 is coupled to the enable line SEL_EN. The gate terminal of the switch transistor T2 is coupled to the enable line RLX_EN. The gate terminal of the switch transistor T3 is coupled to the enable line RLX_EN. The gate terminal of the switch transistor T4 is coupled to the enable line SEL_EN.

The display system employs a recovery operation including the relaxation operation for recovering the display after being under stress and thus reducing the temporal non-uniformity of the pixel circuits.

Figure 4:
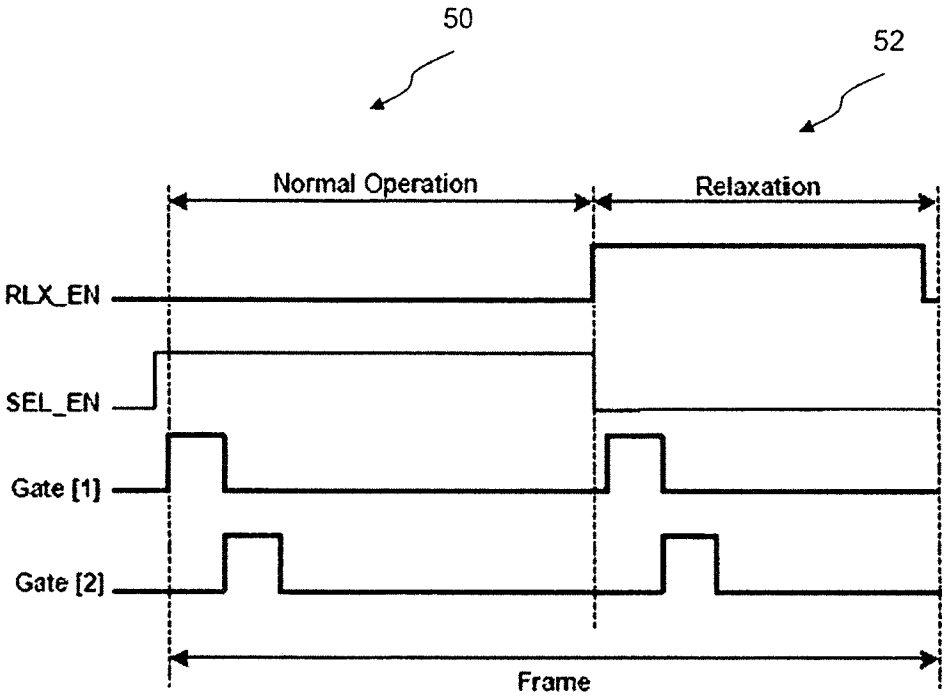
FIG. 4 is a timing diagram showing exemplary waveforms applied to the display system of FIG. 3.

FIG. 4 illustrates a driving scheme for the display system 120 of FIG. 3. Referring to FIGS. 3-4, each frame time operation includes a normal operation cycle 50 and a relaxation cycle 52. The normal operation cycle 50 includes a programming cycle and a driving cycle as well understood by one of ordinary skill in the art. In the normal operation cycle 50, SEL_EN is high so that the switch transistors T1 and T4 are on, and RLX_EN is low so that the switch transistors T2 and T3 are off. In the normal operation cycle 50, SEL [i] (i: the row number, i=1, 2, . . .) is coupled to the gate driver 36 (Gate[i]) via the switch transistor T1, and RLX[i] is coupled to VGL (the off voltage of the gate driver) via the transistor T4. The gate driver 36 sequentially outputs a select signal for each row (Gate[1], Gate [2]). Based on the select signal and a programming data (e.g., Data [1], Data [2]), the display system 120 programs a selected pixel circuit and drives the OLED in the selected pixel circuit.

In the relaxation cycle 52, SEL_EN is low, and RLX_EN is high. The switch transistors T2 and T3 are on, and the switch transistors T1 and T4 are off. SEL[i] is coupled to VGL via the switch transistor T3, and RLX[i] is coupled to the gate driver 36 (Gate [i]) via the switch transistor T2. As a result, the relaxation switch transistor (e.g., 18 of FIG. 1) is on. The switch transistor coupled to the data line (e.g., 16 of FIG. 1) is off. The gate-source voltage of the driving transistor (e.g., 14 of FIG. 1) in the pixel circuit 32 becomes, for example, zero.

In the above example, the normal operation and the relaxation operation are implemented in one frame. In another example, the relaxation operation may be implemented in a different frame. In a further example, the relaxation operation may be implemented after an active time on which the display system displays a valid image.

A recovery driving scheme for improving pixel component stabilities is now described in detail. The recovery driving scheme uses a recovery operation to improve the display lifetime, including recovering the degradation of pixel components and reducing temporal non-uniformity of pixels. The recovery driving scheme may include the relaxation operation (FIGS. 1-4). The recovery operation may be implemented after a active time or in an active time.

Figure 5:
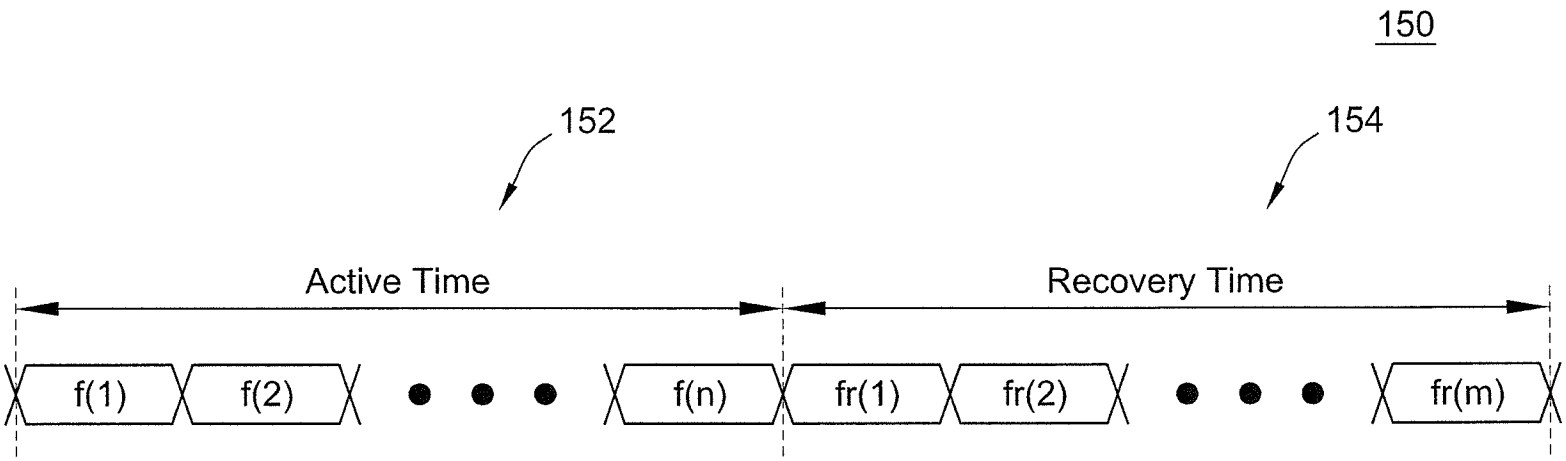
FIG. 5 is a timing diagram showing exemplary frame operations for a recovery driving scheme in accordance with an embodiment of the present invention.

FIG. 5 illustrates a recovery driving scheme for a display system in accordance with an embodiment of the present invention. The recovery driving scheme 150 of FIG. 5 includes an active time 152 and a recovery time 154 after the active time 152. In FIG. 5, "f(k)" (k=1, 2, . . . , n) represents an active frame. In FIG. 5, "fr(1)" (l=1, 2, . . . , m) represents a recovery frame. During the active time 152, the active frames f(1), f(2), . . . , f(n) are applied to a display. During the recovery time 154, the recovery frames fr(1), fr(2), . . . , fr(m) are applied to the display. The recovery driving scheme 150 is applicable to any displays and pixel circuits.

The active time 152 is a normal operation time on which the display system displays a valid image. Each active frame includes a programming cycle for programming a pixel associated with the valid image and a driving cycle for driving a light emitting device. The recovery time 154 is a time for recovering the display and not for showing the valid image.

For example, after a user turns off the display (i.e., turns off a normal image display function or mode), the recovery frames fr(1), . . . , fr(m) are applied to the display to turn over the pixel's components aging. The aging of the pixel elements includes, for example, threshold voltage shift of transistors and OLED luminance and/or electrical degradation. During the recovery frame fr(1), one can operate the display in the relaxation mode (described above) and/or a mode of reducing OLED luminance and electrical degradation.

Figure 6:
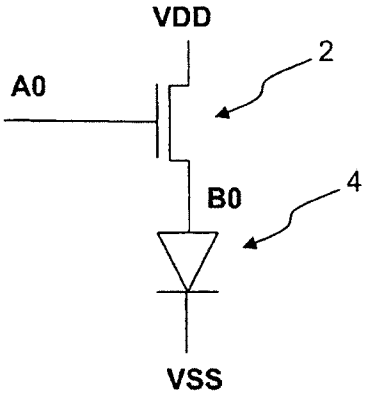
FIG. 6 is a diagram showing an example of pixel components to which the recovery driving scheme of FIG. 5 is applied.

FIG. 6 illustrates one example of pixel components to which the recovery driving scheme of FIG. 5 is applied. As shown in FIG. 6, a pixel circuit includes a driving transistor 2 and OLED 4, being coupled in series between a power supply VDD and a power supply VSS. In FIG. 6. the driving transistor 2 is coupled to the power supply VDD. The OLED 4 is coupled to the driving transistor at node B0 and the power supply line VSS. The gate terminal of the driving transistor 2, i.e., node A0, is charged by a programming voltage. The driving transistor 2 provides a current to the OLED 4.

At least one of VSS and VDD is controllable (changeable). In this example, VSS line is a controllable voltage line so that the voltage on VSS is changeable. VDD line may be a controllable voltage line so that the voltage on VDD is changeable. VSS and VDD lines may be shared by other pixel circuits.

It would be well understood by one of ordinary skill in the art that the pixel circuit may include components other than the driving transistor 2 and the OLED 4, such as a switch transistor for selecting the pixel circuit and providing a programming data on a data line to the pixel circuit, and a storage capacitor in which the programming data is stored.

Figure 7:
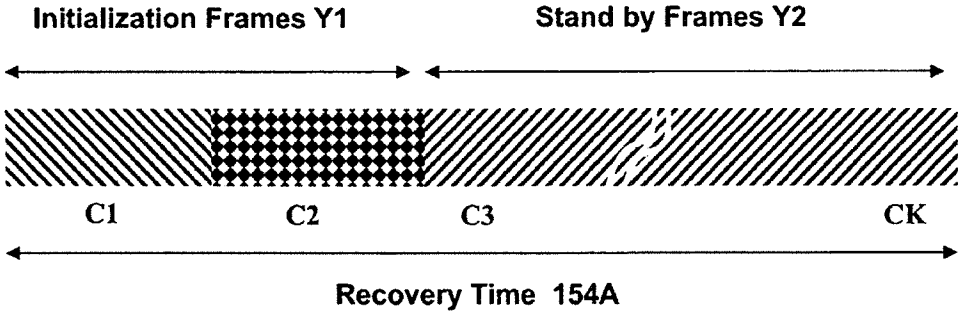
FIG. 7 is a timing diagram showing one example of recovery frames for the recovery driving scheme of FIG. 5.

FIG. 7 illustrates one example of recovery frames associated with the recovery deriving scheme of FIG. 5. The recovery time 154A of FIG. 7 corresponds to the recovery time 154 of FIG. 5, and includes initialization frames Y1 and stand by frames Y2. The initialization frames Y1 include frames C1 and C2. The stand by frames Y2 include frames C3, . . . , CK. The stand by frames Y2 are normal stand by frames.

Referring to FIGS. 6-7, during the first frame C1 in the initialization frames Y1, the display is programmed with a high voltage (VP_R) while VSS is high voltage (VSS_R) and VDD is at VDD_R. As a result, node A0 is charged to VP_R and node B0 is charged to VDD_R. Thus, the voltage at OLED 4 will be—(VSS_R-VDD_R). Considering that VSS_R is larger than VDD_R, the OLED 4 will be under negative bias which will help the OLED 4 to recover.

VSS_R is higher than VSS at a normal image programming and driving operation. VP-R may be higher than that of a general programming voltage VP.

During the second frame C2 in the initialization frames Y1, the display is programmed with gray zero while VDD and VSS preserve their previous value. At this point, the gate-source voltage (VGS) of the driving transistor 2 will be—VDD_R. Thus, the driving transistor 2 will recover from the aging. Moreover, this condition will help to reduce the differential aging among the pixels, by balancing the aging effect. If the state of each pixel is known, one can use different voltages instead of zero for each pixel at this stage. As a result, the negative voltage apply to each pixel will be different so that the recovery will be faster and more efficient.

Each pixel may be programmed with different negative recovery voltage, for example, based on the ageing profile (history of the pixel's aging) or a look up table.

In FIG. 7, the frame C2 is located after the frame C1. However, in another example, the frame C2 may be implemented before the frame C1.

The same technique can be applied to a pixel in which the OLED 4 is coupled to the drain of the driving transistor 2 as well.

Figure 8:
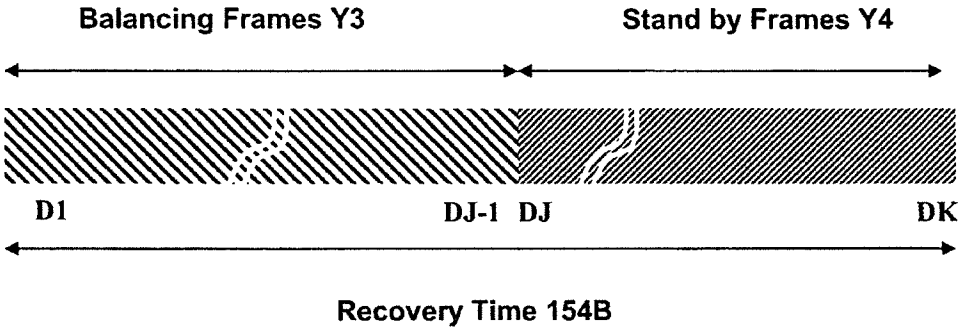
FIG. 8 is a timing diagram showing another example of recovery frames for the recovery driving scheme of FIG. 5.

FIG. 8 illustrates another example of recovery frames associated with the recovery deriving scheme of FIG. 5. The recovery time 154B of FIG. 8 corresponds to the recovery time 154 of FIG. 5, and includes balancing frames Y3 and the stand by frames Y4. The stand by frames Y4 include frames DJ, . . . , Dk. The stand by frames Y4 correspond to the stand by frames Y3 of FIG. 7. The balancing frames Y3 include frames D1, . . . , DJ−1.

During the recovery time 154B, the display runs on uncompensated mode for a number of frames D1−DJ−1 that can be selected based on the ON time of the display. In this mode, the part that aged more start recovering and the part that aged less will age. This will balance the display uniformity over time.

Figure 9:
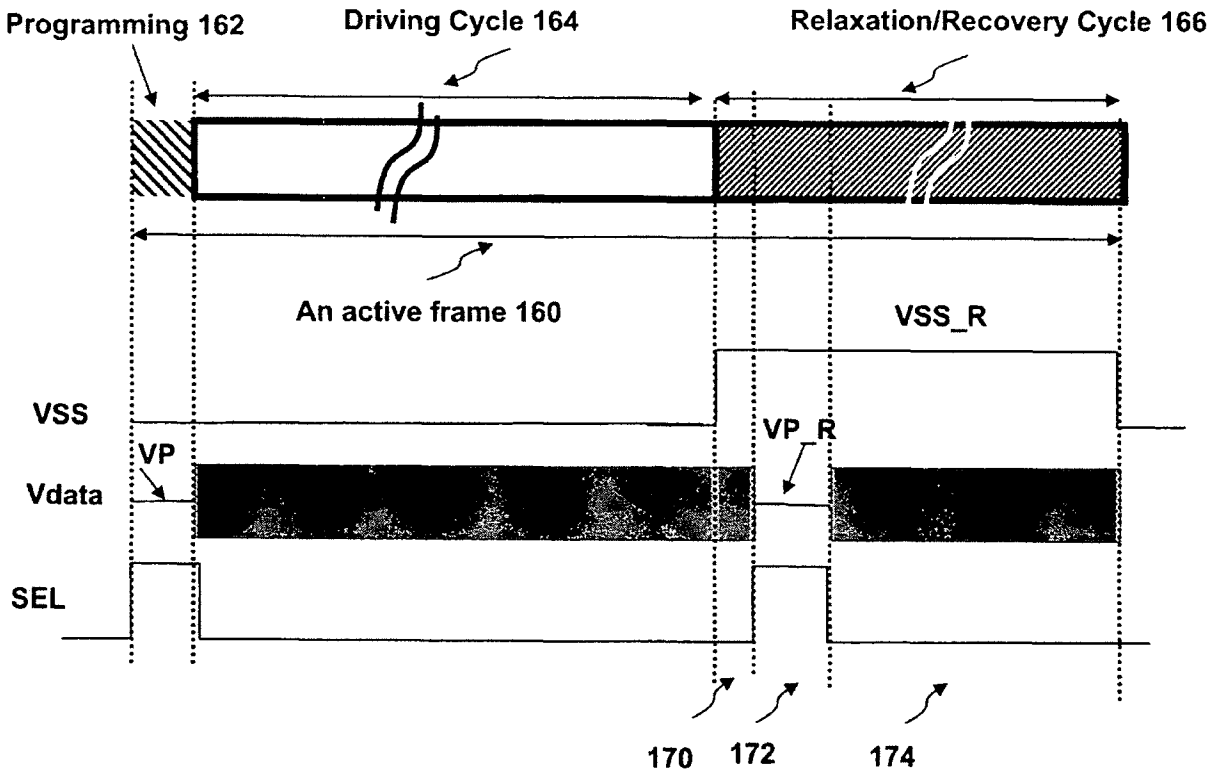
FIG. 9 is a timing diagram showing an example of a driving scheme in accordance with an embodiment of the present invention.

In the above example, the display has the recovery time (154 of FIG. 5) after the active time (152 of FIG. 5). However, in another example, an active frame is divided into programming, driving and relaxation/recovery cycles. FIG. 9 illustrates a further example of a driving scheme for a display in accordance with an embodiment of the present invention. The active frame 160 of FIG. 9 includes a programming cycle 162, a driving cycle 164, and a relaxation/recovery cycle 166. The driving scheme of FIG. 9 is applied to a pixel having the driving transistor 2 and the OLED 4 of FIG. 6.

Referring to FIGS. 6 and 9, during the programming cycle 162, the pixel is programmed with a required programming voltage VP. During the driving cycle 164, the driving transistor 2 provides current to the OLED 4 based on the programming voltage VP. After the driving cycle 164, the relaxation/recovery cycle 166 starts. During the relaxation/recovery cycle 166, the degradation of pixel components is recovered. In this example, the display system implements a recovery operation formed by a first operation cycle 170, a second operation cycle 172 and a third operation cycle 174.

During the first operation cycle 170, VSS goes to VSS_R, and so node B0 is charged to VP-VT (VT: threshold voltage of the driving transistor 4). During the first operation cycle 172, node A0 is charged to VP_R and so the gate voltage of the driving transistor 2 will be—(VP-VT-VP_R). As a result, the pixel with larger programming voltage during the driving cycle 164 will have a larger negative voltage across its gate-source voltage. This will results in faster recovery for the pixels at higher stress condition.

In another example, the display system may be in the relaxation mode during the relaxation/recovery cycle 166.

In a further example, the history of pixels' aging may be used. If the history of the pixel's aging is known, each pixel can be programmed with different negative recovery voltage according to its aging profile. This will result in faster and more effective recovery. The negative recovery voltage is calculated or fetch from a look up table, based on the aging of the each pixel. In the above embodiments, the pixel circuits and display systems are described using n-type transistors. However, one of ordinary skill in the art would appreciate that the n-type transistor in the circuits can be replaced with a p-type transistor with complementary circuit concept. One of ordinary skill in the art would appreciate that the programming, driving and relaxation techniques in the embodiments are also applicable to a complementary pixel circuit having p-type transistors.

1. Some semiconductor devices experience stress annealing or recovery under certain bias, temperature and illumination.

2. For example, oxide semiconductor devices have negative threshold voltage shift under negative bias and illumination condition 3. Here higher energy photons (e.g., in the blue or UV range) can accelerate the negative threshold voltage shift.

Therefore, in one aspect of this invention, a semiconductor device is negatively biased while it is under illumination to induce negative threshold voltage shift in the device.

In another aspect of this invention, a semiconductor device can generate the light by itself to be used for recovery process.

In another aspect of the invention, the semiconductor device can be an array of the pixel and each pixel can be negatively biased and left under illumination.

In another aspect of the invention, the pixel can be biased with different biased levels based on a signal representing the performance of the pixel or aging history of the pixel. The signal can be the stress history, a current level for a given voltage, a voltage for a given current, or any other type of signal representing the pixel performance.

In one aspect of the invention, constant illumination and/or bias conditions are used for recovery.

In another aspect of the invention, pulse illumination and/or bias conditions are used for recovery.

In another aspect of the invention, the negative induced VT shift operation can be followed by stress condition with positive induced VT shift to minimize the gap between the performances of different pixels.

In another aspect of the invention, the negative induced VT shift and positive induced VT shift operations can be repeated multiple times.

Another aspect of this invention will be to use the bias illumination condition to improve non-uniformities associated with the solid state devices, including both initial non-uniformities and those due to aging.

One or more currently preferred embodiments have been described by way of example. It will be apparent to persons skilled in the art that a number of variations and modifications can be made without departing from the scope of the invention as defined in the claims.

The invention claimed is:

1. A method of recovering a display having a plurality of pixels, each having a light emitting device and a driving transistor for driving the light emitting device, the driving transistor and the light emitting device being coupled in series between a first power supply and a second power supply, the method comprising:

illuminating the driving transistor of each pixel of the plurality of pixels while independently negatively biasing the driving transistor of each pixel using a respective recovery voltage different from an image programming voltage, a respective magnitude of negative biasing provided by said respective recovery voltage for each pixel being based specifically on a respective signal representing a performance of said pixel, said respective recovery voltage to reduce non-uniformity of the plurality of pixels including both initial non-uniformities and non-uniformities caused by aging, said illuminating the driving transistor while negatively biasing the driving transistor with the respective recovery voltage producing a negative induced VT voltage shift in the driving transistor; and following said negative induced VT shift in the driving transistor, driving the driving transistor based on said respective signal representing a performance of said pixel to induce a positive VT shift determined to minimize gaps in performances of different pixel circuits.

2. The method of claim 1 in which the illumination is with light in the blue or ultraviolet range.

3. The method of claim 1 in which the negative induced VT shift and the positive induced VT shift are repeated multiple times.

4. The method of claim 1 in which the illumination is generated by said light emitting device of each pixel.

5. The method of claim 1 in which the respective signal representing the performance of the pixel represents a current level for a given voltage or a voltage level for a given current.

6. The method of claim 5 in which non-uniformities associated with the plurality of pixels including both initial non-uniformities and non-uniformities caused by aging are reduced by using different respective recovery voltages to bias the driving transistor of each pixel.

7. The method of claim 1 in which the illumination and the recovery voltage are substantially constant.

8. The method of claim 1 in which the illumination and the recovery voltage are pulses.

9. A method for a display including a plurality of pixel circuits, each having a light emitting device and a driving transistor for driving the light emitting device, the method comprising:

during a first cycle, implementing an image display operation including programming each pixel circuit for a valid image and driving the pixel circuit to emit light according to the programming;

during a second cycle, implementing a recovery operation for recovering a portion of the display, the recovery operation including illuminating the driving transistor of each pixel circuit while independently negatively biasing the driving transistor of each pixel using a respective recovery voltage different from an image programming voltage for a valid image, a respective magnitude of negative biasing provided by said respective recovery voltage for each pixel being based specifically on a respective signal representing a performance of said pixel, said respective recovery voltage to reduce non-uniformity of the plurality of pixels including both initial non-uniformities and non-uniformities caused by aging, said illuminating the driving transistor while negatively biasing the driving transistor with the respective recovery voltage producing a negative induced VT voltage shift in the driving transistor; and following said negative induced VT shift in the driving transistor, driving the driving transistor based on said respective signal representing a performance of said pixel to induce a positive VT shift determined to minimize gaps in performances of different pixel circuits.

10. The method of claim 9 in which the illumination is with light in the blue or ultraviolet range.

11. The method of claim 9 in which the negative induced VT shift and the positive induced VT shift are repeated multiple times.

12. The method of claim 9 in which the illumination is generated by said light emitting device of the pixel circuit.

13. The method of claim 9 in which the respective signal representing the performance of the pixel represents a current level for a given voltage or a voltage level for a given current.

14. The method of claim 13 in which non-uniformities associated with the plurality of pixels including both initial non-uniformities and non-uniformities caused by aging are reduced by using different respective recovery voltages to bias the driving transistor of each pixel circuit.

15. The method of claim 9 in which the illumination and the recovery voltage are substantially constant.

16. The method of claim 9 in which the illumination and the recovery voltage are pulses.

* * * * *